US006292988B1

(12) United States Patent
Jackson et al.

(10) Patent No.: US 6,292,988 B1
(45) Date of Patent: Sep. 25, 2001

(54) SEAT BELT BUCKLE

(75) Inventors: Michael John Jackson, Cullybackey; Mark John Harrison, Ballyhackamore, both of (GB)

(73) Assignee: European Components Co. Limited, Belfast (GB)

( * ) Notice: Subject to any disclaimer, the term of this patent is extended or adjusted under 35 U.S.C. 154(b) by 0 days.

(21) Appl. No.: 09/508,351

(22) PCT Filed: Sep. 9, 1998

(86) PCT No.: PCT/GB98/02714

§ 371 Date: Jul. 3, 2000

§ 102(e) Date: Jul. 3, 2000

(87) PCT Pub. No.: WO99/12441

PCT Pub. Date: Mar. 18, 1999

(30) Foreign Application Priority Data

Sep. 10, 1997 (GB) ..... 9719264

(51) Int. Cl.[7] ..... A44B 11/25

(52) U.S. Cl. ..... 24/641; 24/633; 24/640; 24/636

(58) Field of Search ..... 24/609, 633, 637–646, 24/651, 652, 655, 684

(56) References Cited

U.S. PATENT DOCUMENTS

| | | | | |
|---|---|---|---|---|
| 4,899,424 | * | 2/1990 | Barnes et al. | 24/641 |
| 5,210,915 | * | 5/1993 | Clarke | 24/641 |
| 5,271,129 | * | 12/1993 | Clarke et al. | 24/641 |
| 5,870,810 | * | 2/1999 | Harrison et al. | 24/641 |

FOREIGN PATENT DOCUMENTS

| | | | | |
|---|---|---|---|---|
| 0 341 839-A1 | * | 11/1988 | (EP) | 24/641 |
| 0 341 840 | | 11/1989 | (EP) . | |
| 0 750 862 | | 1/1997 | (EP) . | |
| 2 218 457 | | 11/1989 | (GB) . | |
| 2 238 074 | | 5/1991 | (GB) . | |

* cited by examiner

*Primary Examiner*—James R. Brittain
*Assistant Examiner*—Ruth C. Rodriguez
(74) *Attorney, Agent, or Firm*—Foley & Lardner

(57) ABSTRACT

A seat belt buckle of the general type disclosed in GB-A-2238074 in which the slider (44) has extending downwardly from its body (46) clips (76) having side flanges (78), the flanges being formed with chamfers (80). The body (74) of the locking member (24) is provided with elongate slots (72), into which the clips (76) can be pressed, the flanges (78) retaining the slider in place. The length of the slots (72) and of the clips (78) is chosen to allow adequate sliding movement of the slider (44).

12 Claims, 2 Drawing Sheets

SEAT BELT BUCKLE

The present invention relates to seat belt buckles for seat belts in motor vehicles. One form of such seat belt buckle involves a latch plate having an aperture therein, engageable on one part of the seat belt, and a buckle having a rigid frame including a base having an opening therein and upstanding side walls adapted to guide the latch plate longitudinally of the frame.

The latch plate can be inserted against the action of a spring loaded ejector and when in the fully inserted position a locking member is pivoted to a lower latching position in which a locking element engages in the aperture in the latch plate. A push button is used to release the locking member which pivots back to an unlatched position.

It is important that such seat belt buckles should have an easy and effective latching of the latch plate and should easily release the latch plate by operation of the push button. It is most important to retain the latch plate in a latched position in the buckle even when the latch plate and buckle are subject to a very heavy impact load.

GB-A-2238074 discloses a seat belt buckle adapted to releasably engage a latch plate having an aperture therein, said buckle comprising a rigid frame including a base having an opening therein, upstanding side walls adapted to guide the latch plate longitudinally of the frame, a bar extending transversely of the frame between said side walls, said bar being spaced above the base, a locking member pivotally mounted on the frame and pivotal between a lower latched position and an upper unlatched position, said locking member carrying a downwardly projecting locking element engageable in said aperture in the latch plate to retain the latch plate in place and passing into said opening, a slider slidable longitudinally of the locking member between a first position in which it is located under said bar, to retain the locking member in the lower latched position and the rear of the bar to retain the locking member in its upper unlatched position, a push button to push the slider from its first position to its second position and a slider spring to urge the slider towards its first position.

The present invention is concerned with an improvement in this general type of buckle. In GB-A-2238074, the slider, which is usually formed of a plastics material, includes downwardly extending flanges provided with inwardly facing grooves. The slider is assembled by sliding the side edges of the body of the locking member into these grooves.

According to the present invention the locking member body is provided with at least two elongate slots and the slider with cooperating clips which can pass through the slots and retain the slider in place, the length of the slots being adequate to allow for the necessary sliding movement of the slider.

Such a construction is in fact far simpler to assemble and it is found that it produces a more robust construction than that previously proposed.

In a preferred embodiment a pair of wings extend laterally from said locking member and engage in said side walls, to pivotally and resiliently mount the locking member for movement between its upper and lower positions and at least one stop member extends laterally along said member, said at least one stop member engaging abutments on said rigid frame to prevent flexing of the wings beyond their elastic limit.

The provision of the bar extending over the slider assists in the withstanding of heavy loads and prevents inadvertent release of the buckle. More importantly, however, the provision of the stop member or members prevents excessive flexing of the wings, which acts as the pivot for the locking member, so that the wings never are distorted beyond their elastic limit.

The stop member may take a number of forms but advantageously each stop member extends laterally from the locking member forwardly from the wings and may comprise a pair of arms engaging, at least in the lower latching position of the locking member, against abutments in the side walls. In a simple construction these abutments are in the form of open-topped notches in the upper edges of the side walls into which the arms move in the lower latching position.

Preferably the locking element in the lower latching position of the locking member, has its forward edge spaced from the forward edge of said opening under normal conditions, said at least one stop member and the associated abutments may be adapted to enhance the load bearing capacity of the locking element engaging the forward edge of said opening. Advantageously the rearward edge of said bar and the forward edge of said slider are cooperatingly chamfered to retain the locking member in its upper unlatched position when said forward and rearward edges are inter-engaged by said slider opening.

Advantageously, according to the present invention, the clips are integrally formed with the slider.

Desirably the clips are provided with flanges which engage below the body of the locking member to retain the slider in place. The lower surfaces of the flanges may be chamfered so that the slider may simply be pushed downwardly, relative to the locking member, the clips flexing to pass through the elongate slots and then springing back so that the flanges engage on the lower surface of the locking member.

In order that the present invention may more readily be understood, the following description is given, merely by way of example, reference being made to the accompanying drawings in which.

Figure 1:
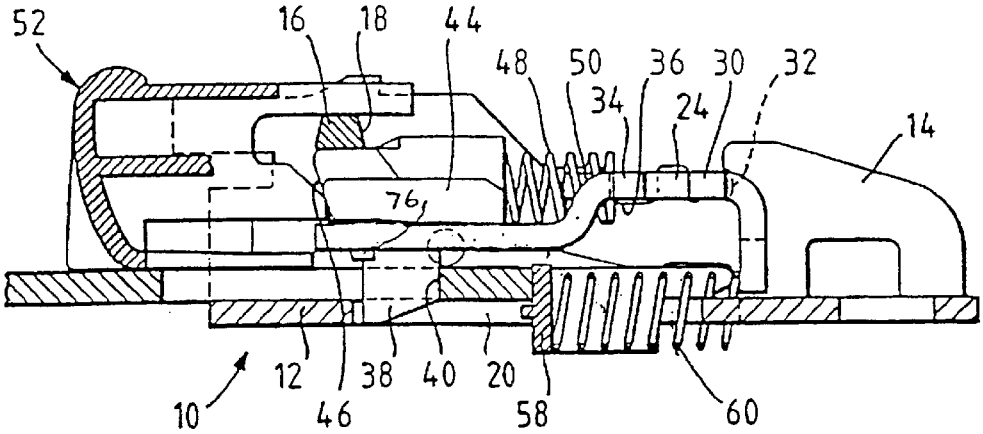
FIG. 1 is a side elevation of one embodiment of the buckle according to the invention shown in the latched position.
Figure 2:
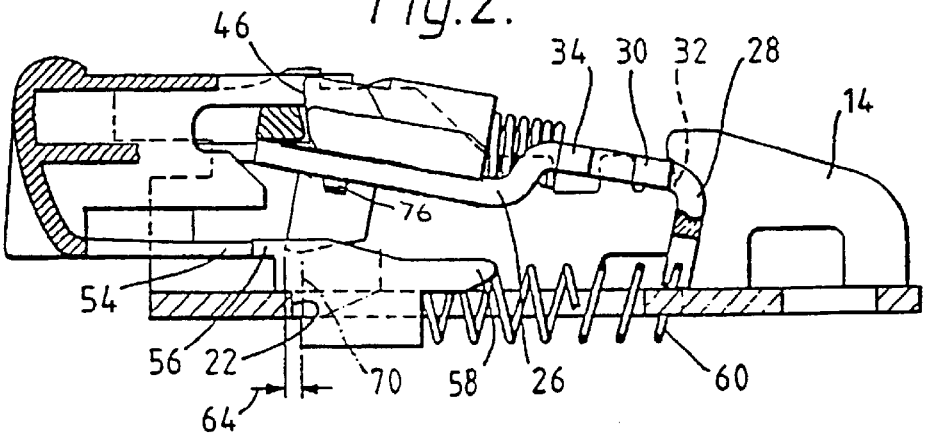
FIG. 2 is a similar view in section in the unlatched position.

Referring first to FIG. 1 the buckle includes a rigid frame 10 having a base plate 12 having two upstanding side walls 14 extending from each side edge thereof. A bar 16 having a rearward edge 18 extends between the side walls 14 and is spaced from and parallel to the base plate 12. An opening 20 is formed in the base plate 12 and is provided with a front edge 22 (FIG. 2).

Pivotally mounted between the side walls 14 is a locking member 24, which includes a forwardly extending body 26 and downwardly extending legs 28. The body is provided with two laterally extending wings 30 engaging in rear notches 32 in the side walls 14. Extending parallel to these wings 30 are arms 34 which can, in the lower latched position as illustrated in FIG. 1, engage in forward notches 36 in the side wall.

At the forward end of the body 26 of the locking member is a locking element 38 which, in the latched position, passes through an aperture 40 in a latch plate 42 to retain the latch plate in place. It will be noted that longitudinally slidable on the locking member 24 is a slider 44 having chamfered leading edge 46. The slider is urged towards the front (the left in the Figures) by a slider spring 48 engaged over a projection 50 on the body 26 of the locking member 24.

Longitudinally slidable on the side walls 14 is a push button 52 which has rearward projections 54 engaging forward projections 56 on an ejector 58 longitudinally slidable in the opening 20 in the base plate 12, and urged to the forward position by an ejector spring 60.

In use, starting from the position illustrated in FIG. 2, a latch plate 42 is inserted in the guide channel formed by the base plate 12 and the side walls 14, it causes the ejector 58 to move rearwardly, that is to the right, against the action of its spring 60. This movement continues until the ejector is moved so far rearwards that it engages on the bottom of the leg 28 of the locking member 24. The resulting couple rotates the locking. member/slider system causing the slider 44 to move down and return under the bar 16 to the position illustrated in FIG. 1. When the plate 42 is unloaded, the aperture 40 therein abuts the locking element 38 which retains the latch plate 42 in place so that the buckle cannot unlatch.

In this condition, if an accident or the like occurs, and a very great strain is put on the buckle, then the latch plate 42 will be urged forward and will move with it the locking element 38, thereby closing the gap 64 illustrated in FIG. 2, so that the front face of the locking element 38 abuts the front face 22 of the aperture 20. During this movement, the wings 30 will flex rearwards but the arms 34 engaging the front of the notches 36 will prevent anything more than a limited flexing so that the wings are not stressed beyond their elastic limit.

Figure 3:
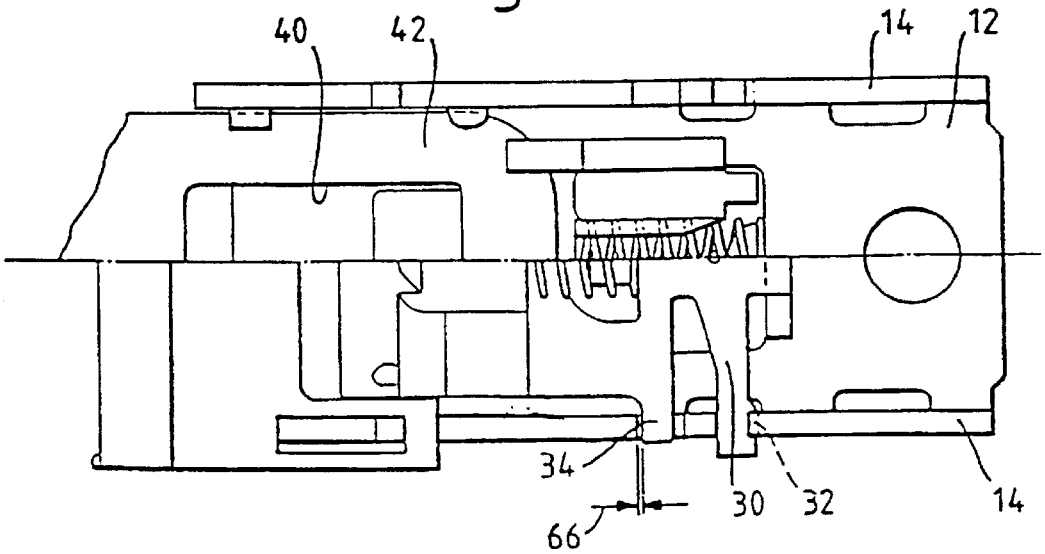
FIG. 3 is a plan view, half in section, of the buckle illustrated in FIGS. 1 and 2.

With the reduction of load (after impact) both the wings and the main body of the locking member recover elastically to restore the clearances 64,66 (FIG. 3) between the locking member 34 and the frame sufficient to allow the front face 70 of the locking element 38 to sweep past the frame edge 22, when the locking member is released to the unlatched position and in particular with the release performed whilst specific test loads are being applied longitudinally through the latch plate.

Figure 4:
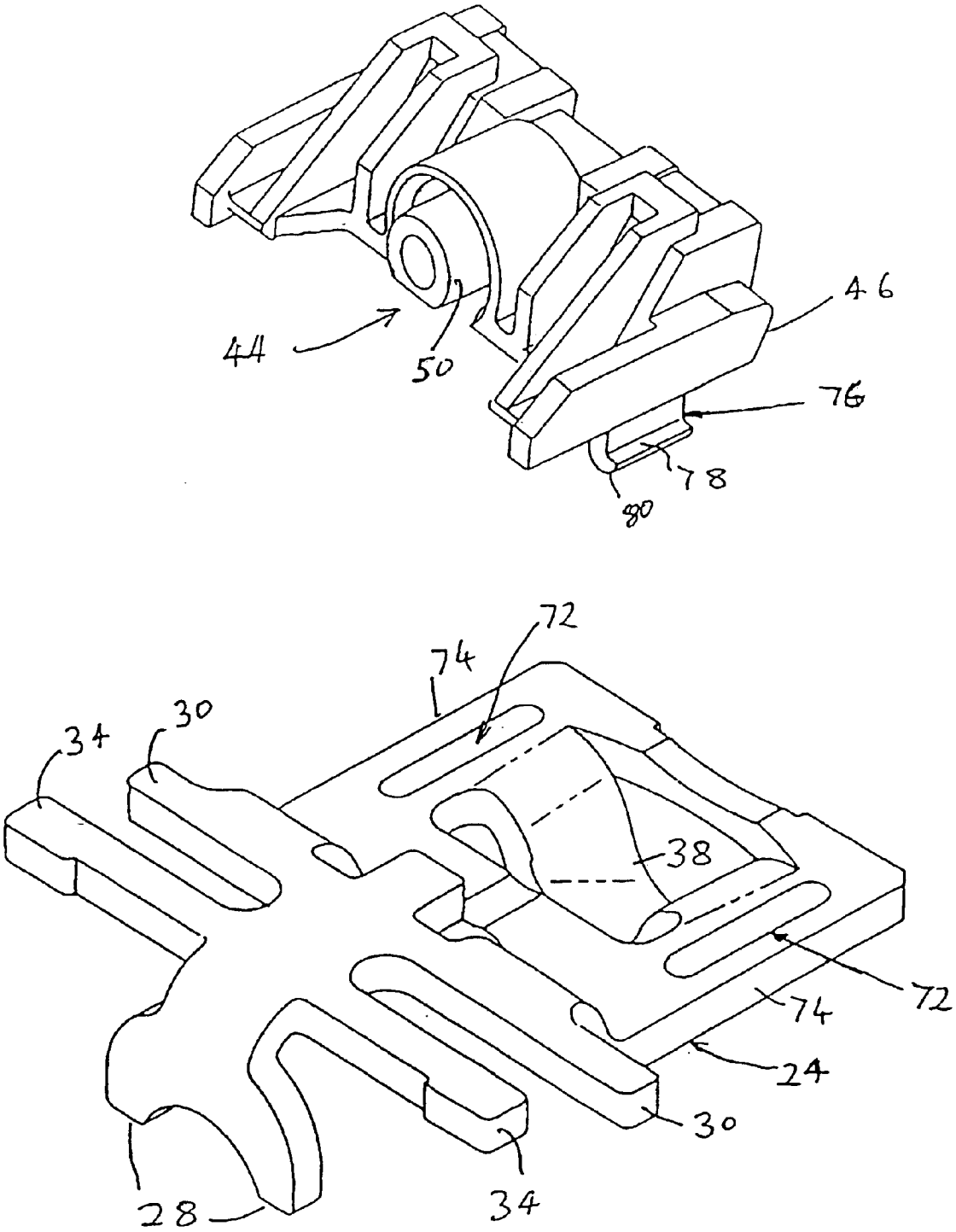
FIG. 4 is an enlarged perspective exploded view of the slider and locking member, showing how the slider is mountable on the locking member.

According to the present invention, and as shown in FIG. 4, the locking member 24 is provided with two longitudinally extending elongate slots 72 one adjacent to and spaced from each side edge 74. Extending downwardly from the slider 44, which is preferably a plastic moulding, are two clips 76 (only one of which is visible), which have outwardly directed flanges 78.

The position and dimensions of the clips, which are integrally formed with the slider, are such as to cooperate with the slots 72, to retain the slider on the locking member 24. The length of the slots and clips are chosen to allow the slider to move longitudinally.

At their free edges, the flanges 78 are chamfered, at 80, allowing the slider to be manually pressed down into place. The clips are sufficiently resilient initially to flex inwardly and then spring outwardly so that the flanges 78 engage the lower surface of the locking member to retain the slider in place.

Of course the flanges may be inwardly directed rather than outwardly directed and the chamfers would then put on the lower inner faces of the clips rather than the lower outer ones as shown.

It will be appreciated that such a structure is very easy to assemble and is rather more robust than that disclosed in our earlier British Patent 2238074.

What is claimed is:

1. A seat belt buckle adapted to releasably engage a latch plate having an aperture therein, said buckle comprising a rigid frame including a base having an opening therein, upstanding side walls adapted to guide the latch plate longitudinally of the frame, a bar extending transversely of the frame between said side walls, said bar being spaced above the base, a locking member pivotally mounted on the frame and pivotal between a lower latched position and an upper unlatched position, said locking member carrying a downwardly projecting locking element engageable in said aperture in the latch plate to retain the latch plate in place and passing into said opening, a slider slidable longitudinally of the locking member between a first position in which it is located under said bar, to retain the locking member in the lower latched position and a second position in which it is resiliently engaged against a rearward edge of the bar to retain the locking member in its upper unlatched position, a push button to push the slider from its first position to its second position and a slider spring to urge the slider towards its first position, the locking member body being provided with at least two elongate slots and the slider being provided with cooperating clips which can pass through the slots and retain the slider in place, the length of the slots being adequate to allow for the necessary sliding movement of the slider.

2. A buckle according to claim 1, wherein the clips are integrally formed with the slider.

3. A buckle according to claim 2, wherein the slider is formed as a plastics material moulding.

4. A buckle according to claim 1, wherein the clips are each provided with flanges adapted to engage under the locking member body to retain the slider in place.

5. A buckle according to claim 4, wherein the clips include ends that are chamfered to enable the clips to be pressed downwardly relative to the locking member body whereby the clips resiliently flex and then spring back to enable the flanges to engage under the locking member body.

6. A buckle according to claim 1, wherein a pair of wings extends laterally from said locking member and engages in said walls to pivotally and resiliently mount the locking member for movement between its upper and lower positions and at least one stop member extends laterally along said member, said at least one stop member engaging abutment on said rigid frame to prevent flexing of said wings beyond their elastic limit.

7. A buckle according to claim 6, wherein said at least one stop member extends laterally from said locking member forwardly of said wings.

8. A buckle according to claim 7, wherein said at least one stop member comprises a pair of arms engaging, at least in the lower latched position of the locking member, against abutments in said side walls.

9. A buckle according to claim 8, wherein an upper edge of at least one of said side walls comprises an abutment formed by a notch.

10. A buckle according to claim 1, wherein the locking element, in the lower latched position of the locking member, has its forward edge spaced from a rearward edge of said opening under normal conditions.

11. A buckle according to claim 10, wherein said at least one stop member and an associated abutment is adapted to enhance a load bearing capacity of the locking element engaging the rearward edge of said opening.

12. A buckle according to claim 1, wherein the rearward edge of said bar and the forward edge of said slider are cooperatingly chamfered to retain the locking member in its upper unlatched position when said forward edge and said rearward edge are inter-engaged by said slider spring.

* * * * *